United States Patent [19]

Pazdirek

[11] 4,150,452

[45] Apr. 24, 1979

[54] PUNCH STRIPPER

[75] Inventor: Jiri V. Pazdirek, Southington, Conn.

[73] Assignee: Textron Inc., Providence, R.I.

[21] Appl. No.: 845,125

[22] Filed: Oct. 25, 1977

[51] Int. Cl.[2] ..... B21K 1/46; B21k 1/64; B21D 53/24; B21D 45/00

[52] U.S. Cl. ..... 10/11 E; 10/76 R

[58] Field of Search ..... 10/7, 11 E, 24, 26, 10/72 R, 72 T, 76 R, 76 T

[56] References Cited

U.S. PATENT DOCUMENTS

| | | | |
|---|---|---|---|
| 1,977,163 | 10/1934 | Wilcox | 10/76 R |
| 3,310,822 | 3/1967 | McClellan et al. | 10/26 X |
| 3,561,026 | 2/1971 | Schaeffer | 10/11 E |

FOREIGN PATENT DOCUMENTS

| | | | |
|---|---|---|---|
| 147384 | 7/1952 | Australia | 10/76 R |
| 289769 | 7/1953 | Switzerland | 10/72 R |

*Primary Examiner*—E. M. Combs

*Attorney, Agent, or Firm*—DeLio and Montgomery

[57] ABSTRACT

A punch stripper for a multiple station high speed cold heading machine, such as a nut former, wherein the stripper is biased in the retraction direction and is advanced momentarily to strip the blank, being immediately withdrawn so that the working tip of the punch can be cooled during a substantial portion of the machine cycle. The stripper is advanced by means of a cam-actuated bell crank, and the stripper and punch are mounted for easy removal and replacement.

9 Claims, 6 Drawing Figures

40 13 37 36 34 35 14 33 30
31 32
26 25
41
27 17 17'
32
38
31
42 40 34 35 15 33 16 30 28

17'
25
270°
17'
W
25
240°
25
W
17'
210°
180°
25
17'
W
150°
TF
W
TF
25
17'
120°
25
90°
17
17'
60°
TIME OF CYCLE
GATE (PUNCH) MOVING FOWARD
DIE FACE 13
42
40
40
38

PUNCH STRIPPER

This invention relates to an improved punch stripper actuating mechanism wherein the stripper is biased in the retraction direction and is advanced momentarily to strip the blank, being immediately withdrawn so that the working tip of the punch can be cooled during a substantial portion of the machine cycle. The stripper is advanced by means of a cam-actuated bell crank, and the stripper and punch are mounted for easy removal and replacement.

It has been customary, in the operation of multiple station high speed cold heading machines, such as nut formers, to strip the blanks from the punches on which they are more or less impaled by means of cylindrical strippers which are retracted only slight distances from their blank contacting positions after each stripping action. The strippers thus form protective sleeves around the punches and prevent the latter from being cooled either by a cooling fluid or even by radiation. This leads to overheating of the punches and resultant shortened tool life. Since the punch and stripper are both subject to wear or breakage, replacement is necessary and this has required disassembly and replacement of the whole punch unit.

It is accordingly an object of the invention to provide a punch stripper assembly wherein the stripper motion is timed so that there is a minimal time period during which the tool (punch) is in contact with the hot blank being worked, so that the tool absorbs a minimal amount of heat.

It is a further object of the invention to operate the stripper bushing so that it is retracted, exposing the working tip of the tool to a flow of cooling liquid during approximately two-thirds of the machine cycle, for effective heat transfer.

It is another object of the invention to provide a design which permits quick replacement of the tool or stripper, independently, without disassembly of other machine components.

It is a still further object of the invention to provide stronger construction of the several elements and more rigid clamping of the punch.

It is yet another object of the invention to provide a simple efficient design wherein only the tool and the stripper bushing need be changed for the production of different sizes of product and wherein the same design can be used for piercing and cup extrusion, at any station.

It is a further object of the invention to provide certain improvements in the form, construction and arrangement of the several parts whereby the above-named and other objects may effectively be attained.

The invention accordingly comprises the features of construction, combination of elements, and arrangement of parts which will be exemplified in the construction hereinafter set forth, and the scope of the invention will be indicated in the claims.

A practical embodiment of the invention is shown in the accompanying drawings, wherein.

Figures 1, 1A, 2:
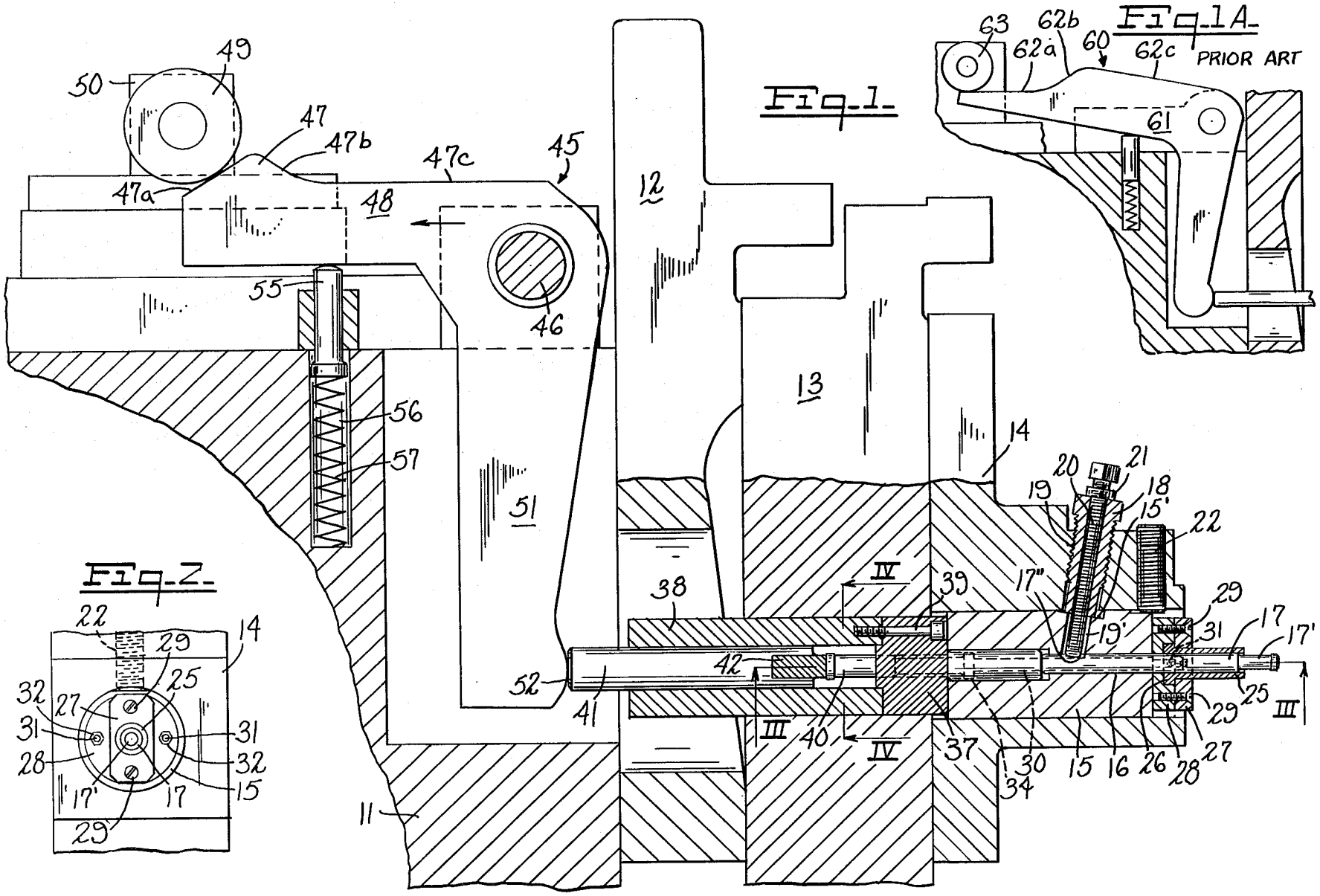
Fig. 1A PRIOR ART
FIG. 1 represents a detail vertical cross-section through the punch, punch carrier and portions of the gate.
FIG. 1A represents a detail vertical cross-section, corresponding to the upper left portion of FIG. 1, showing the previously used configuration of the knockout lever.
FIG. 2 represents a detail front end elevation of the punch and stripper.

Referring to the drawings, the gate 11 is provided with a backing plate 12, punch carrier 13 and punch holder 14, rigidly interconnected in any customary manner, the gate being reciprocated by suitable means, not shown. The punch holder is bored to receive the mounting block 15 which, in turn, is bored at 16 to receive the punch 7 with a close sliding fit, the working tip of the punch being designated 17'. The mounting block 15 is immobilized in the punch holder by means of a hollow set screw 18, threaded in a bore 19 near the forward end of the holder, and the punch itself is retained by the set screw 20 which is threaded through the screw 18 and provided with a lock nut 21. The block 15 has a beveled cut-out 15' in which rests the end of the screw 18 and the punch has a beveled notch 17'' to receive the end of the set screw 20, the angle of the beveled cut-out 15' and notch 17'' corresponding to the deviation from vertical of the bore 19. The bore 19' in the block 15 is somewhat oval in cross-section to permit in-and-out adjustment of the block in a conventional manner. An additional set screw 22 in the punch holder 14 aids in stabilizing the block 15.

The punch stripper 25 is a tubular sleeve with a flange 26 gripped between the front and rear stripper plates 27, 28 which are held together by screws 29, the stripper and rear plate having a free sliding fit on the shaft of the punch. The flange 26 is shown as completely annular and fitted in an annular recess in the plate 28, but it could be segmented, if desired for any reason, and fitted in a correspondingly shaped recess.

Actuation of the stripper is effected through rods 30, on each side of the punch, each rod having its forward end fixed in the rear stripper plate 28 by means of a necked-in portion 31 and nut 32 and each rod passing through a spring chamber 33 bored into the block 15 from the rear. Each rod has an annular shoulder 34, and springs 35 bear against the shoulders 34 and front ends of the chambers 33 to bias the rods rearwardly, in a direction to withdraw the stripper. Rearward from the shoulders the rods 30 terminate within bores 36, in a block 37 which is fixed to the cylindrical sleeve 38 by a bolt 39. Stripper drive pins 40 are slidable in the bores 36 and are driven forward upon actuation of a knockout pin 41 which has a cross-bar 42 in its forward end, serving to communicate the force of forward movement of the pin 41 simultaneously and equally to both of the pins 40.

The drive for the parts just described includes the gate knockout lever 45, in the form of a bell crank, which is pivotally mounted at 46 on a portion of the gate, the cam 47 on the horizontally disposed upper arm 48 of the lever and the cam roll 49 mounted in bracket 50 on a fixed portion of the machine. The downwardly disposed arm 51 of the lever 45 has a rounded face 52 aligned with the axis of the pin 41 and in a position to advance the pin when the lever is rocked around its pivotal axis 46. A plunger 55 is mounted in a cavity 56 in the gate and is urged upwardly by the spring 57, to bias the cam 47 upward toward the roll 49.

Figure 3:
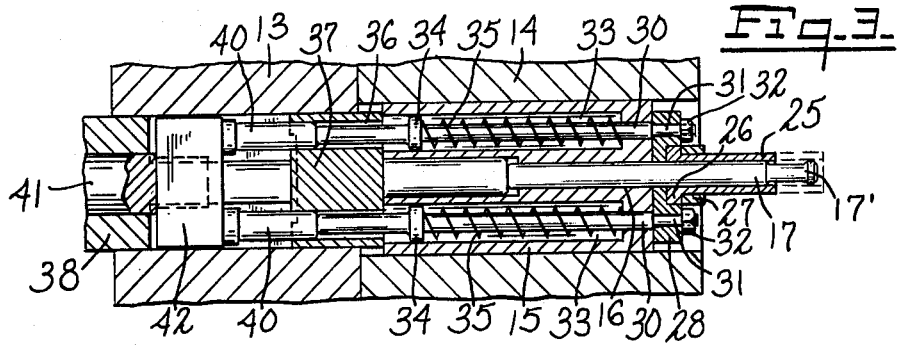
FIG. 3 represents a horizontal axial section on the line III—III of FIG. 1.

FIG. 1 shows the gate, and parts carried thereby, in their advanced position, wherein the cam roll 49 rests against a low point on the rearward slope 47*a* of the cam 47, permitting the stripper to occupy its withdrawn position under the influence of the springs 35, as clearly shown in FIGS. 1 and 3. When the gate starts its rearward movement (to the left in FIG. 1) the cam roll 49 rides up the relatively steep slope 47*a*, depressing the arm 48, rocking forwardly the arm 51 and projecting the stripper sleeve 25 to a position where it can act to remove the work, not shown, from the tip 17' of the punch, in a known manner. Having thus completed its stripping function, the stripper is permitted to be retracted, as the cam surface 47*b* passes under the roll, followed by the flat cam surface 47*c*, as the gate moves to its fully withdrawn position. The stripper is in its advanced position, completely surrounding the punch tip, only momentarily as the peak of the cam between surfaces 47*a* and 47*b* passes under the cam roll; at all other times the punch tip is exposed so that it can be efficiently cooled by means of a cooling fluid and/or by radiation.

The stripper assembly disclosed herein differs from previously known strippers not only in details of its construction but most importantly in its operation, as just described, in contrast to the operation resulting from the use of cam elements as shown in FIG. 1A. In this conventional form of knockout lever 60 the cam surface on the upper arm 61 includes a gently sloping low portion 62*a*, a steeper rearwardly facing portion 62*b* and a flat high portion 62*c*. As such a cam surface passes beneath the cam roll 63, the knockout lever will be moved by the action of the roll on surface portions 62*a*–62*b* to strip the work from an associated punch, not shown, but the high flat surface 62*c* keeps the stripper advanced in a punch-surrounding position, such that effective cooling of the punch tip is impossible.

Figure 5:
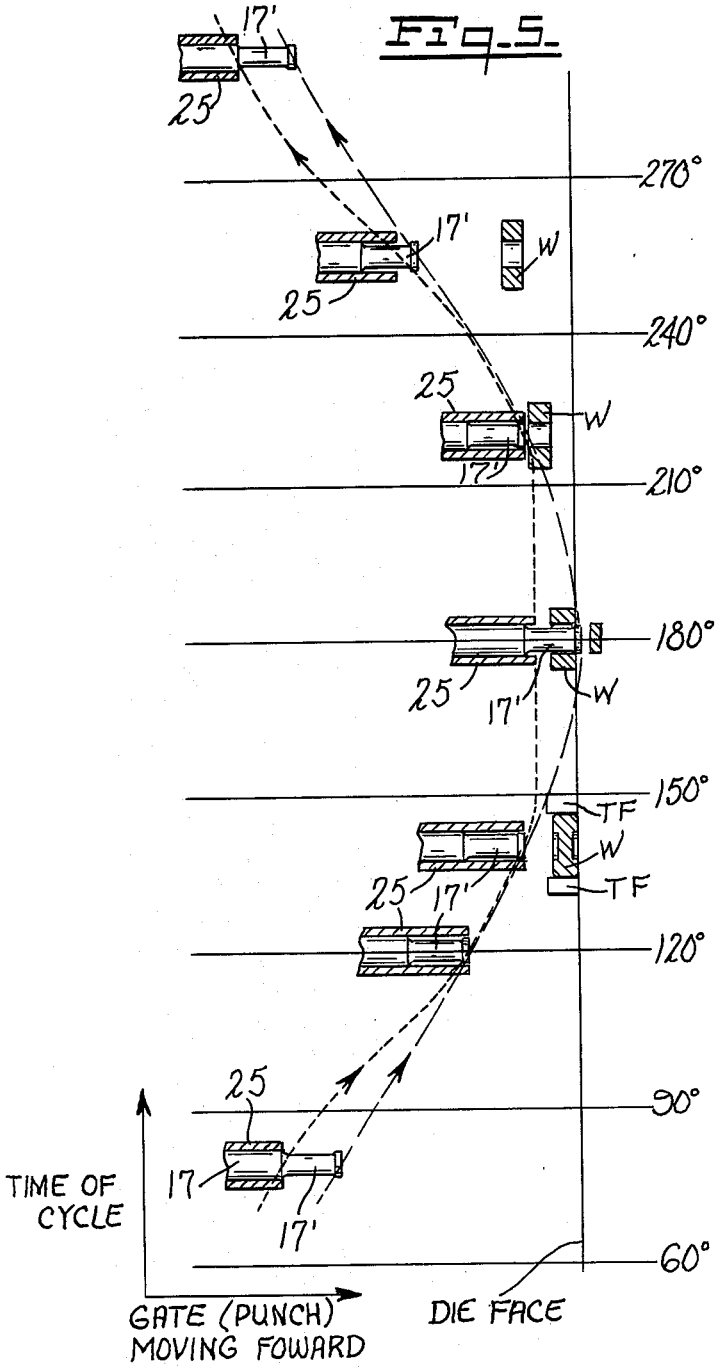
FIG. 5 is a graphic illustration of the cycle of operation of the punch and stripper.
Figure 4:
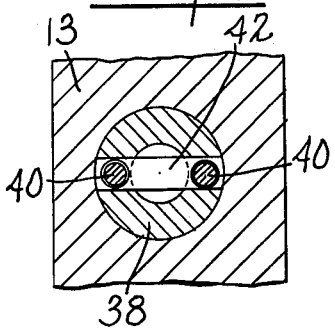
FIG. 4 represents a detail vertical section on the line IV—IV of FIG. 1.

FIG. 5 is a graphic illustration of the relative positions of the punch tip 17', stripper sleeve 25 and work W during a 210° portion of the 360° cycle of operation of the gate in a machine equipped with the stripper mounting and actuating means shown in FIGS. 1, 2, 3 and 4. The stripper motion is indicated by the short-dash line and the punch motion by the long-dash line. The dead center retraction point of the gate driving crank is taken as the 0°–360° point of reference, and the sequence illustrated shows that:

Between 90° and 120° the stripper sleeve moves from a fully retracted position (relative to the punch) to a position fully enclosing the punch as the roll 49 passes along slope 47*b* toward the peak of the cam;

At about 140° the work W is brought by transfer fingers TF into piercing position in front of a die (not shown);

Between about 140° and 180° the punch advances beyond the stripper to pierce or cup-extrude the work, the stripper drawing back from the punch as the roll descends along the slope 47*a* to the FIG. 1 position;

Between 180° and about 220° the punch retracts relative to the stripper, as the latter is advanced by the movement of the slope 47*a* beneath the roll in the direction opposite to that just described (i.e., the 140°–180° phase), the stripper acting to release the work from the punch;

Starting at about 240°, as the slope 47*b* passes under the roll, the stripper is moved back to expose the punch tip, reversing symmetrically the relative movements described between 90° and 120°.

From the foregoing it will be seen that the punch is either wholly encased within the stripper sleeve or acting on the work-piece only during the 120°–240° portion of the cycle, so that it can be subjected to a coolant flow throughout the balance of the cycle, that is 240° to 360° and 0° to 120° or about two-thirds of the complete cycle.

The stripper motion is timed so that there is a minimum time period during which the punch (or other tool) is in direct contact with the hot blank, so that the punch absorbs a minimum amount of heat. Immediately after the hot blank is stripped off the punch the stripper sleeve will retract, exposing the working tip of the punch to a cooling liquid, and the cooling period lasts for about two-thirds of the machine cycle, as explained, thus facilitating transfer of a large amount of heat.

As an additional significant improvement, the structure shown herein makes it possible to replace the punch and/or stripper much more rapidly than in previously known machines. The punch mounting block 15 is held in place by the screws 18 and 22; when they are loosened and the punch retaining screw 20 is removed the block 15 can be withdrawn. To replace the plain punch 17 it is only necessary to loosen lock nut 21 and screw 20. If a headed punch is used, the block 15 must be removed, as just described, the punch being removed rearwardly and replaced, and the block then returned to its fixed operative position with screws 18, 20 and 22 in place and tight. To remove and replace the stripper sleeve one need only remove the screws 29 and front stripper plate 27. In either case there in no need to disassemble the whole punch unit, as has been required in previously known machines.

The present structure is of stronger construction than known machines and provides improved and more rigid punch clamping. It is also simple and less costly to make and to use; only the punch and the stripper bushing need be replaced for production of different sizes of product. The same machine design is adaptable for piercing and cup extrusion operations, and it can be used at any station as a punch timed stripper or ejector.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

What I claim is:

1. In a heading machine having a main frame, a gate and a gate drive, the combination of a punch having a working tip, means mounting the punch removably on the gate, a stripper associated with the punch, means continuously biasing the stripper toward its retracted position, and stripper actuating means, said last named means being synchronized with the gate drive to permit retention of the stripper in retracted relation to the punch tip throughout at least half of the gate drive cycle.

2. In a heading machine according to claim 1, stripper actuating means comprising a gate knockout lever mounted on the gate, a cam roll mounted on the main frame and a cam surface on the knockout lever so shaped as to advance the stripper only at points in the gate drive cycle adjacent the working position of the punch.

3. In a heading machine according to claim 1, punch mounting means comprising a punch holder and a punch mounting block, said block being removably fitted in said holder, and means retaining the block in the holder.

4. In a heading machine according to claim 3, punch mounting means wherein the block retaining means includes at least one set screw.

5. In a heading machine according to claim 4, punch mounting means wherein at least one set screw engages the block at an angle tending to bias the block toward its retained position and one set screw engages the punch.

6. In a heading machine according to claim 1, stripper mounting and actuating means comprising at least one stripper actuating rod and means securing the stripper removably on the forward end of said rod.

7. In a heading machine according to claim 6 which includes a pair of stripper actuating rods located symmetrically with respect to the punch, the stripper being secured to a plate and the plate being secured to the forward ends of both rods in front of the punch mounting means.

8. In a heading machine having a main frame, a gate and a gate drive, the combination of a punch having a working tip, means mounting the punch removably on the gate, a stripper associated with the punch, means continuously biasing the stripper towards its retracted position, and stripper actuating means comprising a gate knockout lever mounted on the gate, a pair of stripper actuating rods located symmetrically with respect to the punch, the stripper being secured to a plate and the plate being secured to the forward ends of both rods and means for communicating movement of said lever to said actuating rods.

9. In a heading machine according to claim 8, stripper biasing means comprising springs under compression, each associated with a respective stripper actuating rod.

* * * * *